US007765831B2

(12) United States Patent
Rodriguez et al.

(10) Patent No.: US 7,765,831 B2
(45) Date of Patent: Aug. 3, 2010

(54) TEMPERATURE CONTROL SYSTEM AND METHOD OF OPERATING SAME

(75) Inventors: Luis Ramon Ocejo Rodriguez, L'hospitalet de Llobregat (ES); Jordi Garcia Farran, Viladecans (ES); Eulalio Nieto Garcia, Barcelona (ES); Lorenzo Garcia Garcia, Sant Just Desvern (ES)

(73) Assignee: Thermo King Corporation, Minneapolis, MN (US)

( * ) Notice: Subject to any disclaimer, the term of this patent is extended or adjusted under 35 U.S.C. 154(b) by 255 days.

(21) Appl. No.: 11/534,245

(22) Filed: Sep. 22, 2006

(65) Prior Publication Data

US 2007/0074528 A1 Apr. 5, 2007

Related U.S. Application Data

(60) Provisional application No. 60/722,269, filed on Sep. 30, 2005.

(51) Int. Cl.
*F25B 1/10* (2006.01)
*F25B 49/02* (2006.01)

(52) U.S. Cl. ..... 62/510; 62/210

(58) Field of Classification Search ..... 62/117, 62/173, 371, 222, 498; 320/112
See application file for complete search history.

(56) References Cited

U.S. PATENT DOCUMENTS

| | | | |
|---|---|---|---|
| 2,102,345 | A | 12/1937 | Wishart |
| 2,696,086 | A | 12/1954 | Jones |
| 3,100,384 | A | 8/1963 | Lowensohn |
| 3,228,205 | A | 1/1966 | Franklin |
| 3,589,816 | A | 6/1971 | Sugaya |
| 3,692,100 | A | 9/1972 | Gallagher, Jr. |
| 3,974,660 | A | 8/1976 | Farr |
| 4,187,093 | A | 2/1980 | Boratgis et al. |
| 4,272,967 | A | 6/1981 | White et al. |
| 4,663,725 | A | 5/1987 | Truckenbrod et al. |

(Continued)

FOREIGN PATENT DOCUMENTS

| | | |
|---|---|---|
| CN | 2513946 | 10/2002 |

(Continued)

OTHER PUBLICATIONS

Eastop, T., McConkey, A., Applied Thermodynamics for Engineering Technologists, Addison Wesley Longman Limited, 1993, p. 528, Singapore, ISBN 0-582-09193-4.

*Primary Examiner*—Frantz F. Jules
*Assistant Examiner*—Emmanuel Duke
(74) *Attorney, Agent, or Firm*—Michael Best & Friedrich LLP

(57) ABSTRACT

An air cargo container temperature control system and method utilizing multiple refrigeration circuits and a controller that activates one or more of the refrigeration circuits in various modes to maintain temperature control. Each of the refrigeration circuits comprises a compressor, a condenser, and an evaporator all in fluid communication to form each refrigeration circuit. Additionally, heating elements are positioned in an evaporator cell for heating load space air and/or defrosting evaporator coils. The system is also provided with a battery pack having a transformer and battery chargers for charging corresponding battery cells by transforming power from an external source. The method compares a measured temperature to a set point temperature and activates one or more refrigeration circuits depending on the temperature difference.

8 Claims, 7 Drawing Sheets

U.S. PATENT DOCUMENTS

| | | | | |
|---|---|---|---|---|
| 5,339,644 | A | 8/1994 | Singh | |
| 5,634,347 | A * | 6/1997 | Hanson et al. | 62/120 |
| 5,791,150 | A | 8/1998 | Bosher et al. | |
| 6,326,766 | B1 * | 12/2001 | Small | 320/112 |
| 6,427,461 | B1 * | 8/2002 | Whinery et al. | 62/176.6 |
| 6,642,632 | B2 | 11/2003 | Lucas et al. | |
| 6,644,049 | B2 * | 11/2003 | Alford | 62/173 |
| 6,742,343 | B2 | 6/2004 | Matonog et al. | |
| 6,910,341 | B2 * | 6/2005 | Srichai et al. | 62/115 |
| 2002/0092318 | A1 * | 7/2002 | Tipton et al. | 62/510 |
| 2003/0014992 | A1 | 1/2003 | Grafton | |
| 2004/0050093 | A1 | 3/2004 | Lifson et al. | |
| 2004/0226309 | A1 | 11/2004 | Broussard | |
| 2005/0066671 | A1 | 3/2005 | Srichai et al. | |

FOREIGN PATENT DOCUMENTS

| | | |
|---|---|---|
| DE | 29613222 | 11/1996 |
| EP | 0060724 | 9/1982 |
| EP | 0327388 | 8/1989 |
| GB | 1170138 | 11/1969 |
| GB | 2098362 | 11/1982 |
| WO | 8501274 | 3/1985 |
| WO | 2004080845 | 9/2004 |

* cited by examiner 42
38
25

25
90
58
74

25

25
58
74
90

25
58
74
90

25

25

TEMPERATURE CONTROL SYSTEM AND METHOD OF OPERATING SAME

REFERENCE TO RELATED APPLICATION

This application claims the benefit of U.S. Provisional Patent Application No. 60/722,269 filed on Sep. 30, 2005, the entire contents of which are incorporated herein by reference.

FIELD OF THE INVENTION

The present invention relates to temperature control systems and, more particularly, to a temperature control system for cargo carriers and a method of operating the same.

SUMMARY

Some embodiments of the present invention provide a temperature control system for conditioning air in a load space. The temperature control system can include a refrigeration circuit extending between a compressor, an evaporator coil, and a condenser. The temperature control system can also include a controller programmed to control operation of the temperature control system and to regulate the temperature of the load space. The controller can be programmed to operate the temperature control system in a cooling mode, a heating mode, and a defrost mode based, at least in part, on data received from one or more sensors distributed along the refrigeration circuit and/or positioned in the load space. In addition, some embodiments of the present invention include a battery and an on-board charger for recharging the battery using an external power supply.

In addition, some embodiments of the invention provide a method for controlling operation of a temperature control system having a plurality of refrigeration circuits, a battery pack, and a power cord. The method can include the acts of sensing a temperature in a load space, operating the temperature control system in a heating mode or cooling mode based, at least in part, on the sensed temperature, powering the temperature control system with power from the battery, and recharging the battery with an external power source.

Other aspects of the invention will become apparent by consideration of the detailed description and accompanying drawings.

Figure 1:
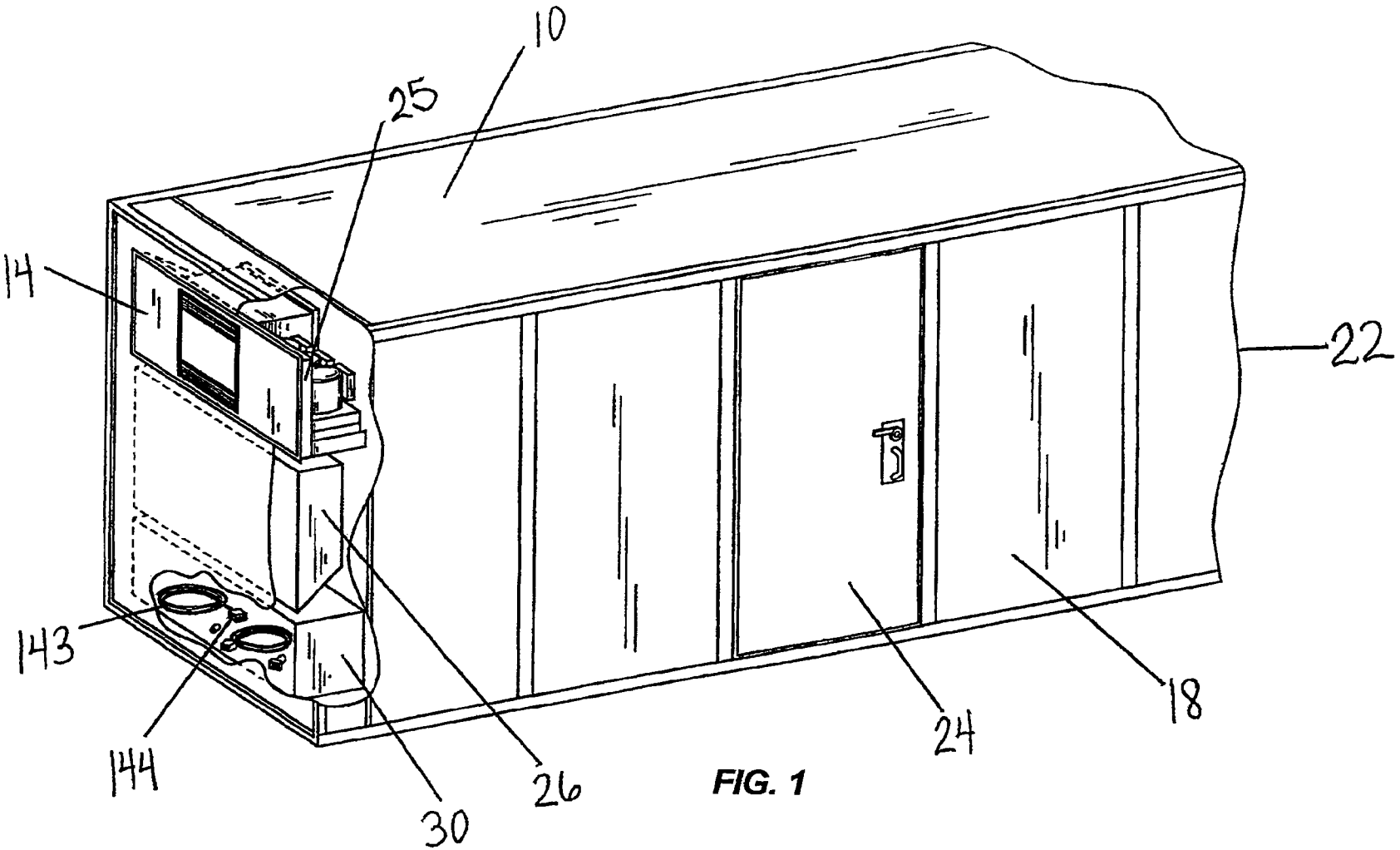
FIG. 1 is a front perspective view of a carrier and a temperature control system according to some embodiments of the present invention.
Figures 2, 3, 4, 5, 6, 7, 8:
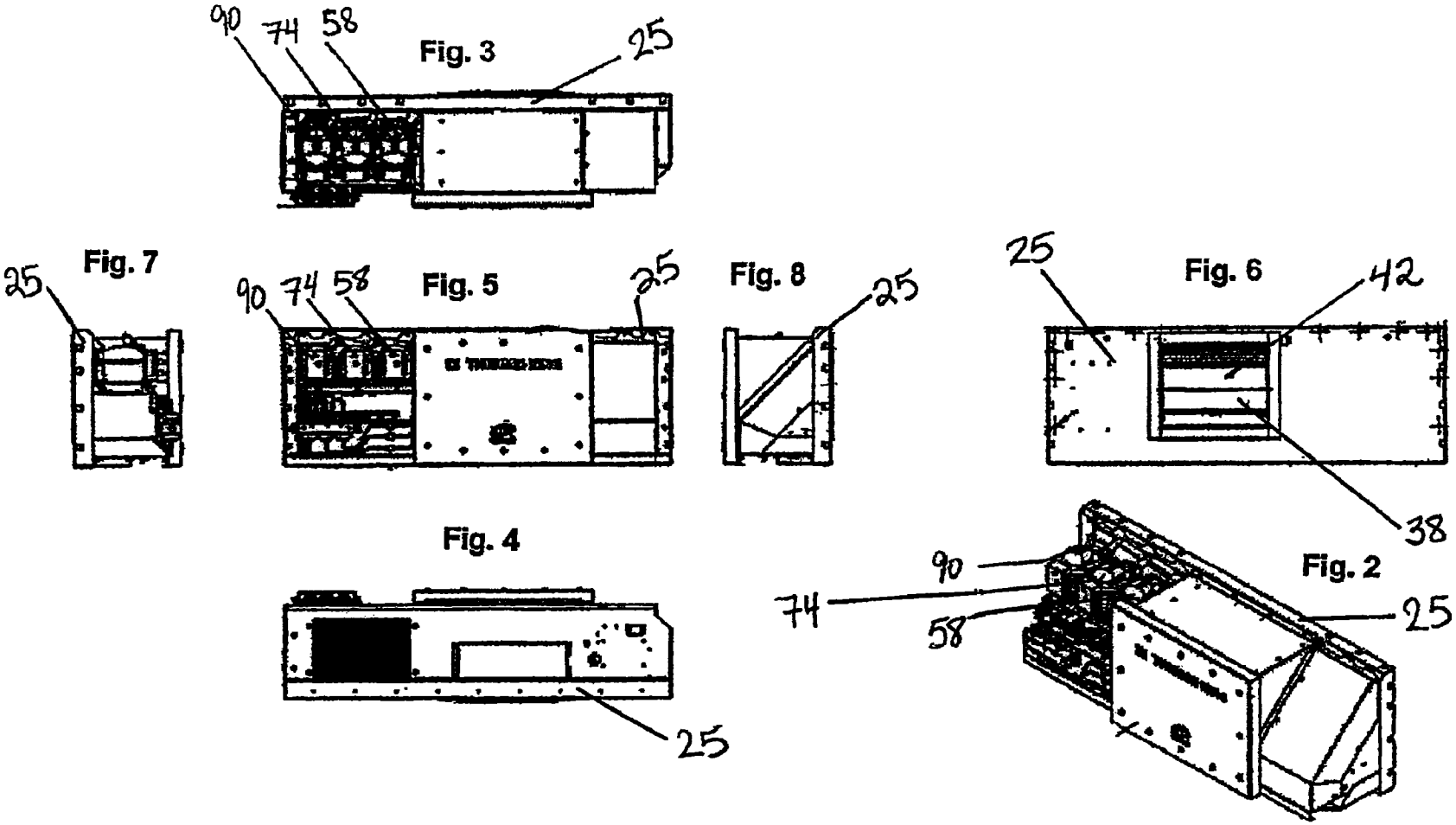
FIG. 2 is a front perspective view of the temperature control system shown in FIG. 1.
FIG. 3 is a top view of the temperature control system shown in FIG. 1.
FIG. 4 is a bottom view of the temperature control system shown in FIG. 1.
FIG. 5 is a front view of the temperature control system shown in FIG. 1.
FIG. 6 is a rear view of the temperature control system shown in FIG. 1.
FIG. 7 is a left side view of the temperature control system shown in FIG. 1.
FIG. 8 is a right side view of the temperature control system shown in FIG. 1.

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "central," "upper," "lower," "front," "rear," and the like) are only used to simplify description of the present invention, and do not alone indicate or imply that the device or element referred to must have a particular orientation. The elements of the temperature control system referred to in the present invention can be installed and operated in any orientation desired. In addition, terms such as "first," "second," and "third" are used herein for purposes of description and are not intended to indicate or imply relative importance or significance.

Also, the use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings connections, supports, and couplings. Further, "connected" and "coupled" are not restricted to physical or mechanical connections or couplings.

DETAILED DESCRIPTION

FIG. 1 illustrates a carrier 10 and a temperature control system 14 according to some embodiments of the present invention. The carrier 10 of the illustrated embodiment is a shipping container and can be mounted on a straight truck, a tractor-trailer combination, a railcar, a ship, a boat, and/or an airplane. As shown in FIG. 1, the carrier 10 includes an outer wall 18, which at least partially defines a load space 22 and which at least partially supports the temperature control system 14. The outer wall 18 includes a cargo door 24, which provides access to the load space 22 for loading cargo into and unloading cargo from the load space 22.

As used herein, the term "load space" includes any space to be temperature and/or humidity controlled, including transport and stationary applications for the preservation of food, beverages, plants, flowers, and other perishables and maintenance of a desired atmosphere for the shipment of industrial products.

In some embodiments, the temperature control system 14 can include a housing 25, a battery pack 26, and a storage chamber 30. In the illustrated embodiment of FIG. 1, the temperature control system housing 25, the battery pack 26, and the storage chamber 30 are located adjacent to the load space 22 in respective upper, central, and lower portions of the carrier 10. In other embodiments, the temperature control system housing 25, the battery pack 26, and the storage chamber 30 can have alternative relative orientations (e.g., horizontally or vertically in-line, or spaced throughout the carrier 10) and locations within the carrier 10 (e.g., the temperature control system housing 25 can be located in a lower portion of the carrier 10, the battery pack 26 can be located in a central portion of the carrier 10, and the storage chamber 30 can be located in a lower portion of the carrier 10).

The temperature control system 14 of the illustrated embodiment of FIG. 1 is operable to condition load space air and to maintain load space air temperature and/or humidity within a desired range surrounding a set point temperature $T_{SP}$ (e.g., 5° C.) and/or a set point humidity $H_{SP}$ (e.g., 60°).

In some embodiments, the temperature control system housing 25 supports an evaporator 34 and defines an air inlet 38 and an air outlet 42. In other embodiments, the temperature control system housing 25 can include two, three, or more air inlets 38 and/or two, three, or more air outlets 42. During operation of the temperature control system 14 and as explained in greater detail below, one or more fans or blowers 44 draw air from the load space 22 into the evaporator 34 through the air inlet 38, direct the load space air across evaporator coils (described below), and vent the air back into the load space 22 through the air outlet 42. In some embodiments, load space air is also or alternately vented to the outside of the carrier 10 to vent $CO_2$ or other exhaust gasses from the load space 22 and to maintain the quality of the air in the load space 22.

Figure 9:
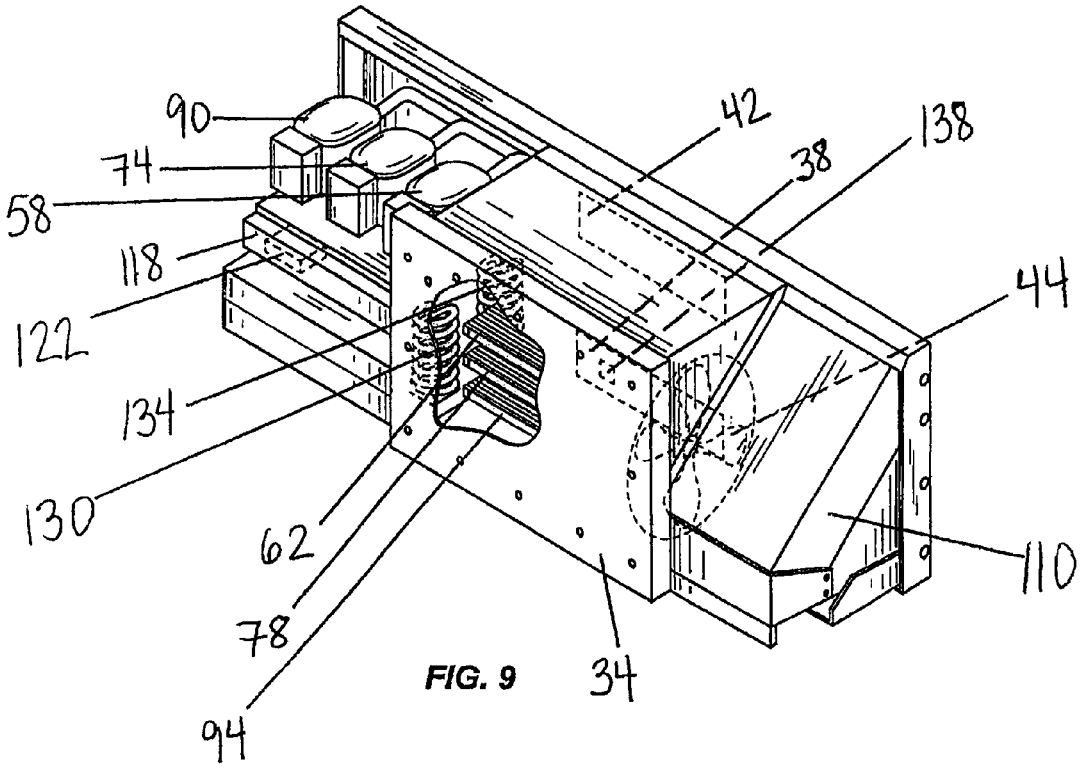
FIG. 9 is an enlarged front perspective view of the temperature control system shown in FIG. 1 with a portion cut away.
Figure 10:
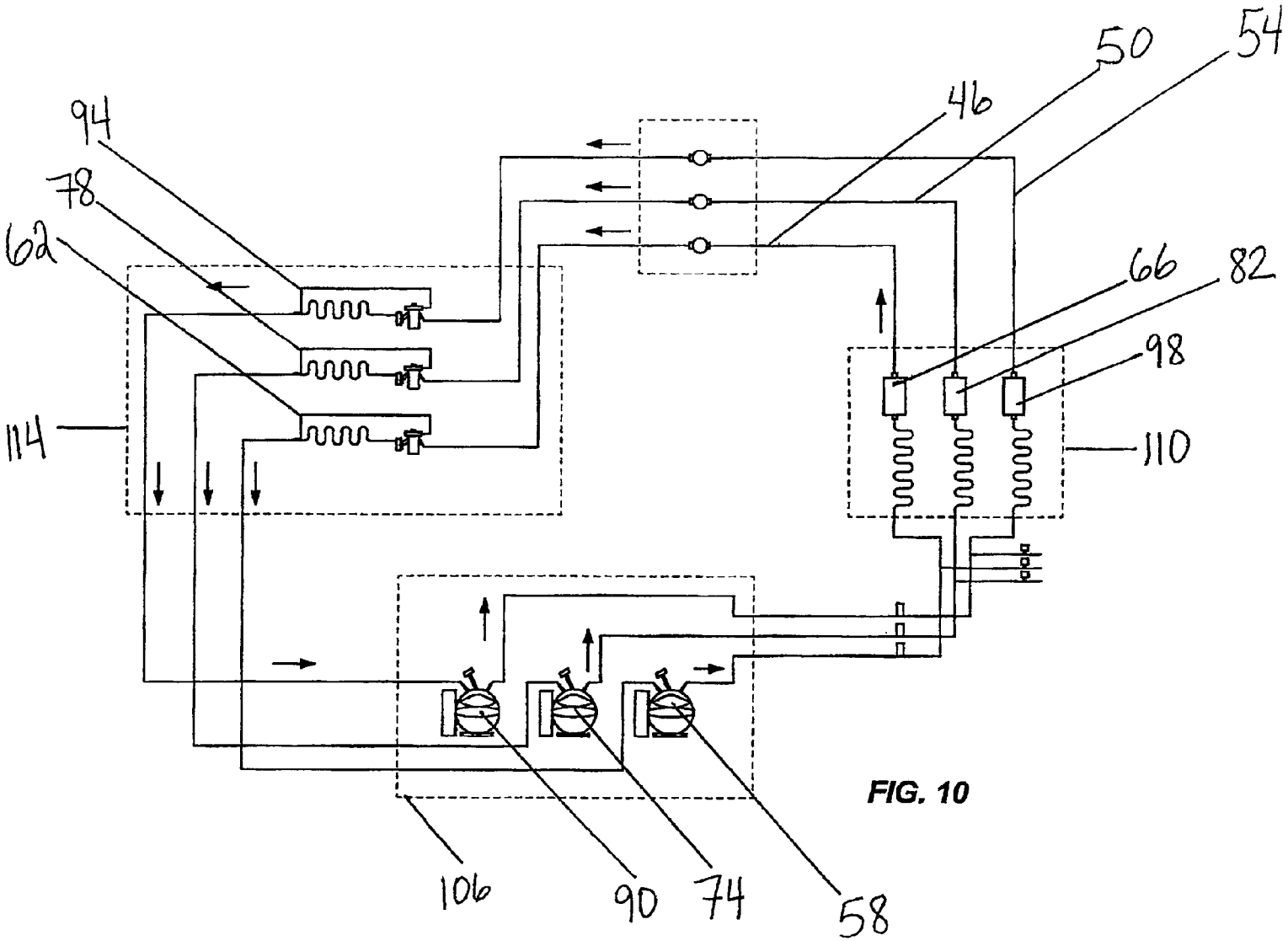
FIG. 10 is a schematic illustration of the temperature control system shown in FIG. 1.

In the illustrated embodiment of FIGS. 1 and 9, the temperature control system housing 25 supports a first refrigeration circuit 46, a second refrigeration circuit 50, and a third refrigeration circuit 54. In other embodiments, the temperature control housing 25 can at least partially support one, two, four, or more refrigeration circuits.

In some embodiments, such as the illustrated embodiment of FIGS. 2-10, the first refrigeration circuit 46 includes and fluidly connects a compressor 58 (e.g., a hermetic compressor), an evaporator coil 62, and a condenser 66 located in respective upper, lower, and central portions of the temperature control system housing 25. More particularly, in the illustrated embodiment of FIGS. 1-10 of the present invention, the compressor 58 is positioned on one side of the temperature control system housing 25, the condenser 66 is positioned on the other side of the temperature control system housing 25, and the evaporator coil 62 extends through the evaporator 34. In other embodiments, one or more of the compressor 58, evaporator coil 62, and condenser 66 can have alternative relative orientations (e.g., horizontally or vertically in-line or spaced throughout the housing) and locations within the housing 25 (e.g., the condenser 66 can be located in an upper portion of the housing 25, the compressor 58 can be located in a central portion of the housing 25, and the evaporator coil 62 can be located in a lower portion of the housing 25).

In embodiments having a second refrigeration circuit 50, such as the illustrated embodiment of FIGS. 2-10, the second refrigeration circuit 50 can include and fluidly connect a compressor 74 (e.g., a hermetic compressor), an evaporator coil 78, and a condenser 82 located in respective upper, lower, and central portions of the temperature control system housing 25. More particularly, in the illustrated embodiment of FIGS. 1-10 of the present invention, the compressor 74 is positioned on one side of the temperature control system housing 25 adjacent to the compressor 58 of the first refrigeration circuit 46, the condenser 82 is positioned on the other side of the temperature control system housing 25 adjacent to the condenser 66 of the first refrigeration circuit 46, and the evaporator coil 62 extends through the evaporator 34 adjacent to the evaporator coil 62 of the first refrigeration circuit 46. In other embodiments, one or more of the compressor 74, evaporator coil 78, and condenser 82 can have alternative relative orientations and locations within the housing 25.

In embodiments having a third refrigeration circuit 54, such as the illustrated embodiment of FIGS. 2-10, the third refrigeration circuit 54 can include and fluidly connect a compressor 90 (e.g., a hermetic compressor), an evaporator coil 94, and a condenser 98 located in respective upper, lower, and central portions of the temperature control system housing 25. More particularly, in the illustrated embodiment of FIGS. 2-10 of the present invention, the compressor 90 is positioned on one side of the temperature control system housing 25 adjacent to the compressor 58 of the first refrigeration circuit 46 and the compressor 74 of the second refrigeration circuit 50, the condenser 98 is positioned on the other side of the temperature control system housing 25 adjacent to the condenser 66 of the first refrigeration circuit 46 and the condenser 82 of the second refrigeration circuit 50, and the evaporator coil 94 extends through the evaporator 34 adjacent to the evaporator coil 62 of the first refrigeration circuit 46 and the evaporator coil 78 of the second refrigeration circuit 50. In other embodiments, one or more of the compressor 90, evaporator coil 94, and condenser 98 can have alternative relative orientations and locations within the housing 25.

In the illustrated embodiment of FIGS. 2-10, the compressors 58, 74, and 90 of the first second and third refrigeration circuits 46, 50, 54 are grouped together to define a compressor cell 106. The condensers 66, 82, 98 of the first, second and third refrigeration circuits 46, 50, 54 are grouped together to define a condenser cell 110. The evaporators 62, 78, and 94 of the first, second and third refrigeration circuits 46, 50, 54 are grouped together and are positioned together to define an evaporator cell 114. In the illustrated embodiment of FIGS. 2-10, the evaporator cell 114 is positioned in the evaporator housing 25.

In some embodiments of the present invention, the temperature control system 14 includes a controller 118 having a microprocessor 122 which controls and coordinates operation of the temperature control system 14. In these embodiments, the controller 118 is programmed to operate the temperature control system 14 in a COOLING mode, a HEATING mode, a DEFROST mode, and a NULL mode, based at least in part upon the set point temperature $T_{SP}$, the set point humidity $H_{SP}$, the ambient temperature, the load space temperature, and/or the cargo in the load space 22.

The temperature control system 14 can include one or more temperature sensors 138. In some embodiments, a temperature sensor 138 is positioned in the load space 22 to record load space temperature. In other embodiments, a temperature sensor 138 is positioned in the air inlet 38. In still other embodiments, a temperature sensor 138 is positioned in the air outlet 42. The temperature control system 14 can also or alternately include temperature and/or pressure sensors distributed along one or more of the first, second, and third refrigeration circuits 46, 50, 54 for sensing the temperature and/or pressure of refrigerant in one or more of the first, second, and third refrigeration circuits 46, 50, 54. In these embodiments, data recorded by the sensors 138 is transmitted to the controller 118.

As shown in FIGS. 2-10, the temperature control system 14 can include one or more heating elements (e.g., heating coils, pan heaters, propane-fueled burners, and the like) positioned in the evaporator 34 for heating load space air and/or defrosting the evaporator coils 62, 78 94. In other embodiments, warm refrigerant can be directed through the evaporator coils 62, 78, 94 to warm load space air, or alternatively, to defrost the evaporator coils 62, 78, 94 during operation in the DEFROST mode. In the illustrated embodiment of FIGS.

2-10, first and second heating elements 130, 134 are positioned in the evaporator 34 adjacent to the evaporator coils 62. 78. 94.

Figure 11:
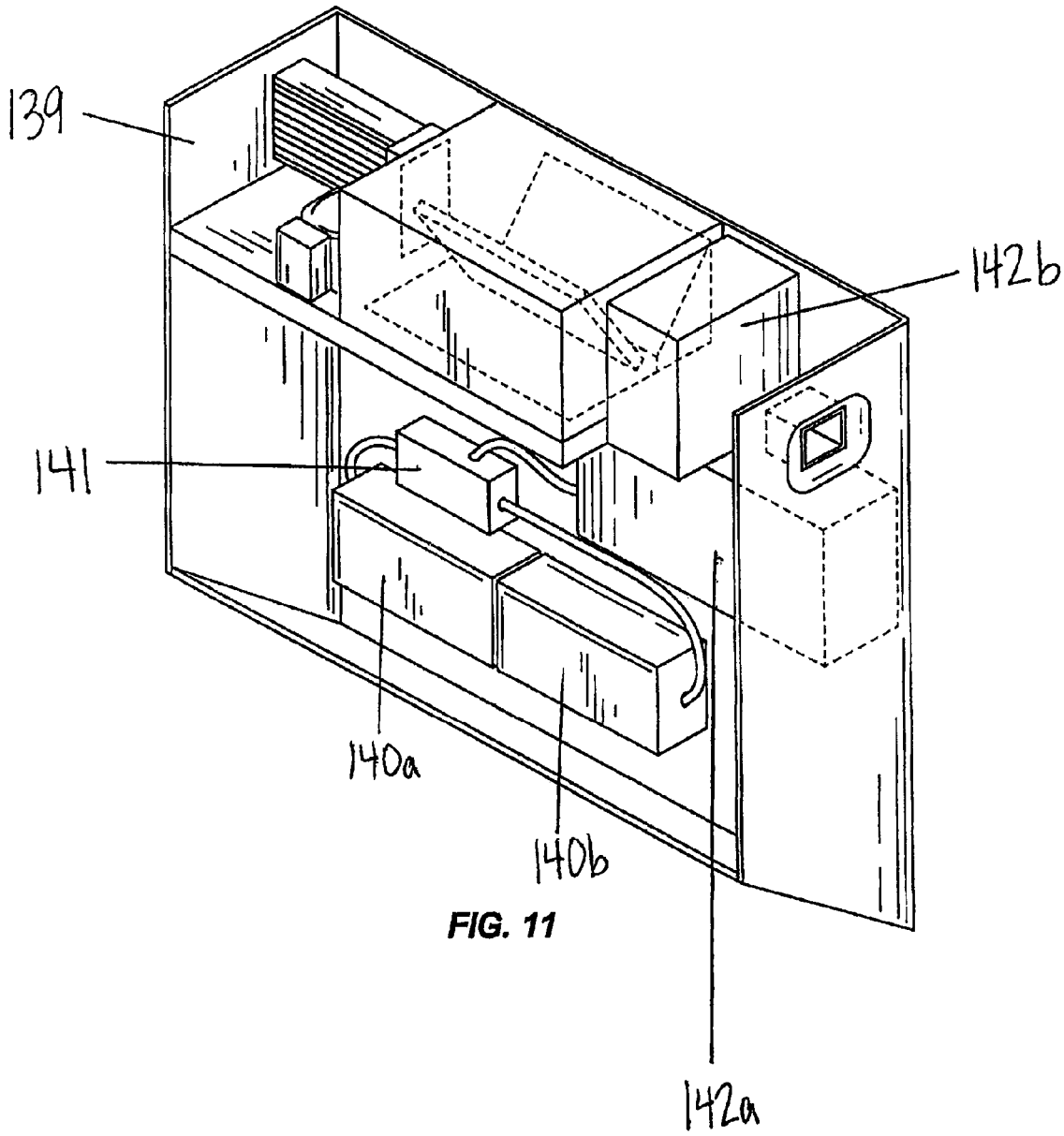
FIG. 11 is rear perspective of the battery pack shown in FIG. 1.

As mentioned above, the temperature control system 14 can include a battery pack 26. In the illustrated embodiment of FIGS. 1 and 11, the battery pack 26 includes a battery housing 139 supported in an opening in the outer wall 18 adjacent to the temperature control system housing 25.

The battery pack 26 of the illustrated embodiment includes first and second battery cells 140*a*, 140*b*. In other embodiments, the battery pack 26 can include one, two, four, or more battery cells 140. Each of the battery cells 140 is operable to store an electrical charge and to power the temperature control system 14.

During normal operation of the temperature control system 14, the battery cells 140*a*, 140*b* supply power to elements of the temperature control system 14. In this manner, the temperature control system 14 can operate independently for extended periods of time (e.g., between about twenty and about forty hours) without requiring an external power supply. More particularly, the temperature control system 14 and the carrier 10 of the present invention can be loaded onto airplanes and other vehicles and can be moved away from external power supplies for extended periods of time.

The battery pack 26 also supports a transformer 141 and first and second battery chargers 142*a*, 142*b* for charging corresponding battery cells 140*a*, 140*b*. When the electrical charge in one or more of the battery cells 140*a*, 140*b* is low and/or when the temperature control system 14 and the carrier 10 are located near an external power supply (e.g., in a warehouse or on a loading dock), electrical power can be transferred from the external power supply to the battery chargers 142*a*, 142*b* to charge the battery cells 140*a*, 140*b* and to power elements of the temperature control system 14. In some embodiments, electrical power is directed through the transformer 141, which transforms the electrical power from the external power source into a form which can be stored by the batteries (e.g., the transformer converts the electrical power from AC to DC). In other embodiments, the transformer 141 and/or the battery chargers 142*a*, 142*b* convert power from a first voltage to a second voltage (e.g., from 24 volts to 12 volts).

In some embodiments, such as the illustrated embodiment of FIG. 1, a power cord 143 is stored in the storage chamber 30. In these embodiments, an operator can use the power cord 143 to electrically connect one or more of the battery chargers 142*a*, 142*b* and the transformer 141 to the external power source. In addition, in some embodiments, a number of plugs or adapters 144 are housed in the storage chamber 30. Each of the adapters 144 has a different configuration and is engageable with a different external power source.

Figure 12A:
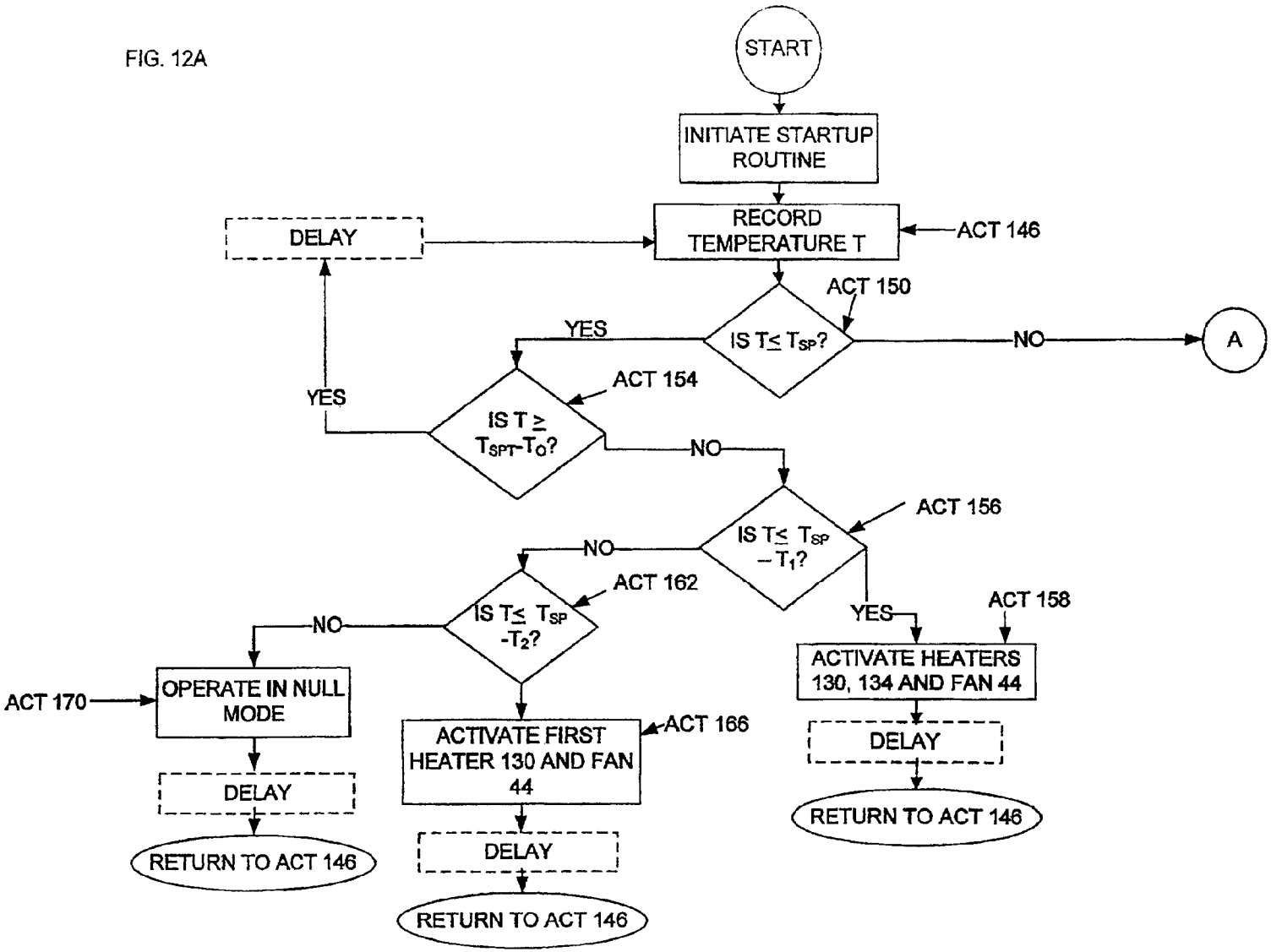
FIGS. 12A-12B are flowcharts illustrating a method operating a temperature control system according to the present invention.
Figure 12B:
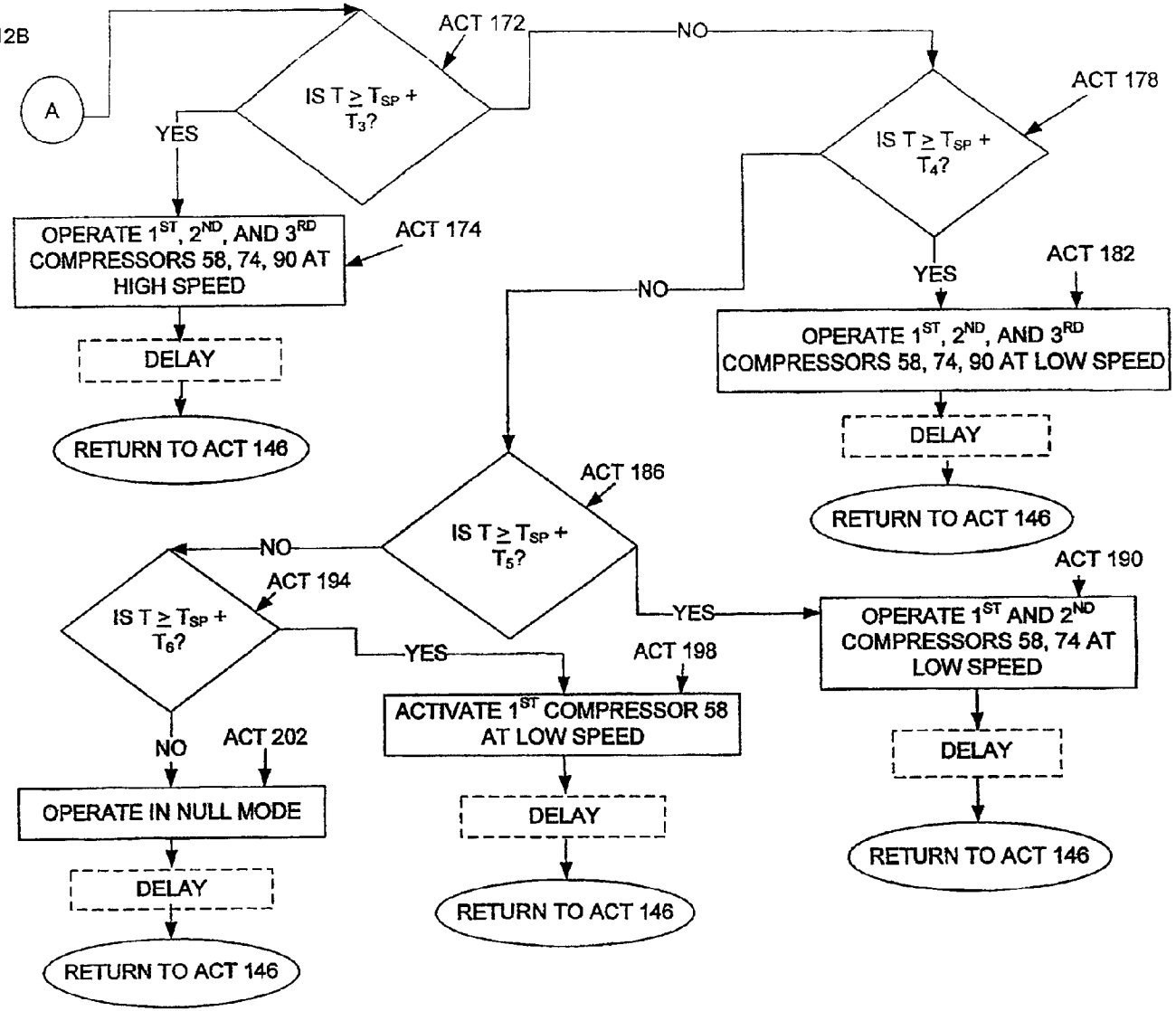

FIGS. 12A and 12B illustrate a method of operating a temperature control system 14 according to the present invention. More particularly, FIGS. 12A and 12B outline an algorithm in the form of a computer program that can be used to practice the present invention.

Each time the temperature control system 14 is switched on (i.e., booted-up), the controller 118 initiates a startup routine. Among other things, the startup routine determines if the temperature control system 14 is operating correctly and searches for errors in the controller's programming and mechanical failures in the temperature control system 14. If an error is detected, the controller 118 can be programmed to activate an alarm to alert an operator.

Following startup, the temperature sensor(s) 138 record a temperature T and transmit temperature data to the controller 118 at act 146. As explained above, temperature sensors 138 can be positioned throughout the load space 22 and the temperature control system 14. Accordingly, in some embodiments of the present invention, the temperature T recorded by the sensors 138 can be the temperature of air in the load space 22, the temperature of air entering the evaporator 34, the temperature of air in the air inlet 38, the temperature of air exiting the evaporator 34, the temperature of air in the air outlet 42, and/or the temperature of refrigerant exiting the evaporator coils 62, 78, 94 of first, second, and third refrigeration circuits 46, 50, 54.

At act 150, the controller 118 compares the temperature T recorded by the sensor(s) 138 to the set point temperature $T_{SP}$. If the temperature T is greater than the set point temperature $T_{SP}$ ("NO" at act 150), the controller 118 is programmed to operate the temperature control system 14 in a COOLING mode (described below). Alternatively, if the temperature T is less than or equal to the set point temperature $T_{SP}$ ("YES" at act 150), the controller 118 is programmed to move to act 154.

At act 154, the controller 118 can be programmed to determine whether the temperature T is greater than or equal to the total of the set point temperature $T_{SP}$ minus a temperature constant $T_0$ (e.g., between about 0.2° C. and about 0.3° C.). If the temperature T is greater than or equal to the total of the set point temperature $T_{SP}$ minus the temperature constant $T_0$ "YES" at act 154), the controller 118 is programmed to return to act 146. In some embodiments, the controller 118 can be programmed to include a delay (e.g., 2 minutes) between act 154 and act 146. If the temperature T is less than the total of the set point temperature $T_{SP}$ minus the temperature constant $T_0$ ("NO" at act 154), the controller 118 is programmed to move to act 156.

At act 156, the controller 118 is programmed to determine whether the temperature T is less than or equal to the total of the set point temperature $T_{SP}$ minus a temperature constant $T_1$ (e.g. between about 0.5° C. and about 0.6° C.). If the temperature T is less than or equal to the total of the set point temperature $T_{SP}$ minus the temperature $T_1$ ("YES" at act 156), the controller 118 is programmed to move to act 158 and to activate the first and second heaters 130, 134 and the tan 44 to heat the load space air. The controller 118 then returns to act 146. In some embodiments the controller 118 can be programmed to include a delay (e.g., 2 minutes) between act 158 and act 146. If the temperature T is greater than the total of the set point temperature $T_{SP}$ minus the temperature constant $T_1$ ("NO" at act 156), the controller 118 is programmed to move to act 162.

At act 162, the controller 118 is programmed to determine whether the temperature T is less than or equal to the total of the set point temperature $T_{SP}$ minus a temperature constant $T_2$ (e.g., between about 0.4° C. and about 0.5° C.). If the temperature T is less than the total of the set point temperature $T_{SP}$ minus the temperature constant $T_2$ ("YES" at act 162), the controller 118 is programmed to move to act 166 and to activate the first heater 130 and the fan 44 to heat the load space air. The controller 118 then returns to act 146. In some embodiments, the controller 118 can be programmed to include a delay (e.g., 2 minutes) between act 166 and act 146. If the temperature T is greater than the total of the set point temperature $T_{SP}$ minus the temperature constant $T_2$ ("NO" at act 162), the controller 118 is programmed to move to act 170.

At act 170, the controller 118 is programmed to deactivate the first and second heaters 130, 134 and the fan 44 and to operate the temperature control system 14 in a NULL mode. In some embodiments the controller 118 is programmed to operate the temperature control system 14 in the NULL mode for a predetermined time and then to return to act 146. In other embodiments, the controller 118 is programmed to include a delay (e.g., 2 minutes) between act 170 and act 146.

As mentioned above, the controller 118 is programmed to operate the temperature control system 14 in a COOLING mode if the temperature T is greater than the set point temperature $T_{SP}$ ("NO" at act 150). As shown in FIG. 12B, the controller 118 is programmed to determine whether the temperature T is greater than or equal to the sum of the set point temperature $T_{SP}$ and a temperature constant $T_3$ (e.g., between about 1.5° C. and about 1.2° C.). If the temperature T is greater than the sum of the set point temperature $T_{SP}$ and the temperature constant $T_1$ ("YES" at act 172), the controller 118 is programmed to move to act 174 and to operate compressors 58, 74, 90 of the first, second, and third refrigeration circuits 46,50, 54 at HIGH speed and operate the fan 44 to direct load space air across the evaporator coils 62, 78, 94 of the first second, and third refrigeration circuits 46, 50, 54 to cool the load space air. The controller 118 then returns to act 146. In some embodiments, the controller 118 can be programmed to include a delay (e.g., 2 minutes) between act 174 and act 146. If the temperature T is less than the sum of the set point temperature $T_{SP}$ and the temperature constant $T_3$ ("NO" at act 172) the controller 118 is programmed to move to act 178.

At act 178, the controller 118 is programmed to determine whether the temperature T is greater than or equal to the sum of the set point temperature $T_{SP}$ and a temperature constant $T_4$ (e.g. between about 1.1° C. and about 1.2° C.). If the temperature T is greater than or equal to the sum of the set point temperature $T_{SP}$ and the temperature constant $T_4$ ("YES" at act 178), the controller 118 is programmed to move to act 182 and to operate the compressors 58, 74, 90 of the first, second, and third refrigeration circuits 46, 50, 54 at LOW speed and to operate the fan 44 to direct load space air across the evaporator coils 62, 78, 94 of the first, second, and third refrigeration circuits 46, 50, 54 to cool the load space air. The controller 118 then returns to act 146. In some embodiments, the controller 118 can be programmed to include a delay (e.g., 2 minutes) between act 182 and act 146. If the temperature T is less than the sum of the set point temperature $T_{SP}$ and the temperature constant $T_4$ ("NO" at act 178), the controller 118 is programmed to move to act 186.

At act 186, the controller 118 is programmed to determine whether the temperature T is greater than or equal to the sum of the set point temperature $T_{SP}$ and a temperature constant $T_5$ (e.g., between about 0.7° C. and 0.8° C.). If the temperature T is greater than or equal to the sum of the set point temperature $T_{SP}$ and the temperature constant $T_5$ ("YES" at act 186), the controller 18 is programmed to move to act 190 and to operate the compressors 58, 74 of the first and second refrigeration circuits 46, 50 at LOW speed and operate the fan 44 to direct load space air across the first and second evaporator coils 62, 78 to cool the load space air. The controller 118 then returns to act 146. In some embodiments, the controller 118 can be programmed to include a delay (e.g., 2 minutes) between act 190 and act 146. If the temperature T is less than the sum of the set point temperature $T_{SP}$ and the temperature constant $T_5$ ("NO" at act 186), the controller 118 is programmed to move to act 194.

At act 194, the controller 118 is programmed to determine whether the temperature T is greater than or equal to the sum of the set point temperature $T_{SP}$ and a temperature constant $T_6$ (e.g., between about 0.3° C. and about 0.4° C.). If the temperature T is greater than or equal to the sum of the set point temperature $T_{SP}$ and the temperature constant $T_6$ ("YES" at act 194), the controller 118 is programmed to move to act 198 and to operate the compressor 58 of the first refrigeration circuit 46 at LOW speed and operate the fan 44 to direct load space air across the evaporator coil 62 of the first refrigeration circuit 46 to cool the load space air. The controller 118 then returns to act 146. In some embodiments, the controller 118 can be programmed to include a delay (e.g., 2 minutes) between act 198 and act 146. If the temperature T is less than the sum of the set point temperature $T_{SP}$ and the temperature constant $T_6$ ("NO" at act 194), the controller 18 is programmed to move to act 202.

At act 202, the controller 118 is programmed to deactivate the compressors 58, 74, 90 of the first, second, and third refrigeration circuits 46, 50, 54 and the fan 44 and to operate the temperature control system 14 in the NULL mode. In some embodiments the controller 118 is programmed to operate the temperature control system 14 in the NULL mode for a predetermined time and then to return to act 146. In other embodiments, the controller 118 is programmed to include a delay (e.g., 2 minutes) between act 202 and act 146.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

For example, while reference is made herein to a temperature control system 14 having temperature sensors 138 and to a method of operating a temperature controls system based at least in part, upon temperature data, in alternate embodiments of the present invention, the temperature control system 14 can include one or more pressure sensors and the temperature control system 14 can be controlled and/or operated using pressure data recorded by the pressure sensors.

What is claimed is:

1. A method of operating an air cargo container temperature control system Utilizing multiple refrigeration circuits, each circuit having a compressor, a condenser and an evaporator in fluid communication with each other, comprising the steps of: initiating a start-up routine to determine if the temperature control system is operating correctly; sensing temperature to record a temperature T and transmit temperature data to a system controller; comparing the temperature T recorded by a sensor to a set point temperature Tsp and if the temperature T is greater than the set point temperature Tsp, the controller is programmed to calculate the difference between T and Tsp and determine whether to continue in null mode or to operate the temperature control system in a cooling mode, and if the cooling mode is chosen, the controller is programmed to choose between a high speed cooling mode in which at least one of the compressors operates at a high speed and a low speed cooling mode in which at least one of the compressors operates at a low speed; and if the temperature T is less than or equal to the set point temperature Tsp then the controller is programmed to calculate the difference between T and Tsp and determine whether to operate in null mode or to activate heater elements to heat load space air; wherein the controller is programmed to determine whether the temperature T is greater than or equal to the sum of the set point temperature Tsp and a temperature constant T3 and if the temperature T is greater than the sum of the set point temperature Tsp and the temperature constant T3 the controller moves to operate all compressors and refrigeration circuits at high speed and operate a fan to direct load space air across the evaporator coils of all of the refrigeration circuits to cool load space air; wherein if the temperature T is less than the sum of the set point temperature Tsp and the temperature constant T3 the controller is programmed to determine whether the temperature T is greater than or equal to the sum of the set point temperature Tsp and a temperature constant T4 and if the temperature T is greater than or equal to the sum of the set point temperature Tsp and the temperature constant T4 the controller moves to operate the compressors of all refrigeration circuits at low speed and operate the fan to direct load space air across the evaporator coils of all of the refrigeration circuits to cool the load space air.

2. The method of claim 1 wherein if the temperature T is less than the sum of the set point temperature $T_{sp}$ and $T_4$, the controller is programmed to determine if temperature T is greater than or equal to the sum of the set point temperature $T_{sp}$ and a temperature constant $T_5$ and if the temperature T is greater than or equal to the sum of $T_{sp}$ and $T_5$, the controller moves to operate the compressors of the first and second refrigeration circuits at low speed and operate the fan to direct load space air across the first and second evaporator coils to cool load space air.

3. The method of claim 2 wherein if the temperature T is less than the sum of the set point temperature $T_{sp}$ and $T_5$, the controller is programmed to determine if the temperature T is greater than or equal to the sum of the set point temperature $T_{sp}$ and a temperature constant $T_6$ and if the temperature T is greater than or equal to the sum of $T_{sp}$ and $T_6$, the controller moves to operate the compressor of the first refrigeration circuit at low speed and operate the fan to direct load space air across the first evaporator coil to cool load space air.

4. The method of claim 3 wherein if the temperature T is less than the sum of the set point temperature $T_{sp}$ and a temperature constant $T_6$, but more than $T_{sp}$, the controller is programmed to deactivate the compressors of all refrigeration circuits and operate the temperature control system in a null mode.

5. The method of claim 4 wherein if the temperature T is less than $T_{sp}$ minus a temperature constant $T_1$, the controller is programmed to activate first and second heaters and the fan to heat load space air.

6. The method of claim 4 wherein if the temperature T is greater than a total of $T_{sp}$ minus T, but less than $T_{sp}$ minus $T_2$, the controller is programmed to activate the first heater and fan to heat load space air.

7. The method of claim 6 wherein if the temperature T is less than $T_{sp}$ but is greater than $T_{sp}$ minus $T_2$, the controller is programmed to deactivate the heaters and the compressors and operate the temperature control system in a null mode.

8. A method of operating an air cargo container temperature control system utilizing multiple refrigeration circuits, each circuit having a compressor, a condenser and an evaporator in fluid communication with each other, comprising the steps of:

initiating a start-up routine to determine if the temperature control system is operating correctly;

sensing temperature to record a temperature T and transmit temperature data to a system controller;

comparing the temperature T recorded by the sensor to a set point temperature $T_{sp}$ and if the temperature T is greater than the set point temperature $T_{sp}$ the controller is programmed to calculate a difference and determine whether to continue in null mode or to operate the temperature control system in a cooling mode;

if the temperature T is less than or equal to the set point temperature $T_{sp}$ then the controller is programmed to calculate the difference between T and $T_{sp}$ and determine whether to continue in null mode or to activate heater elements to heat load space air;

if the temperature T is greater than or equal to the sum of the set point temperature $T_{sp}$ and a temperature constant $T_3$, the controller moves to operate all compressors and refrigeration circuits at high speed and operate a fan to direct load space air across the evaporator coils of all of the refrigeration circuits to cool load space air;

if the temperature T is less than the sum of the set point temperature $T_{sp}$ and the temperature constant $T_3$ the controller is programmed to determine whether the temperature T is greater than or equal to the sum of the set point temperature $T_{sp}$ and a temperature constant $T_4$ and if the temperature T is greater than or equal to the sum of the set point temperature $T_{sp}$ and the temperature constant $T_4$ the controller moves to operate the compressors of all refrigeration circuits at low speed and operate the fan to direct load space air across the evaporator coils of all of the refrigeration circuits to cool the load space air;

if the temperature T is less than the sum of the set point temperature $T_{sp}$ and $T_4$, the controller is programmed to determine if temperature T is greater than or equal to the sum of the set point temperature $T_{sp}$ and a temperature constant $T_5$ and if the temperature T is greater than or equal to the sum of $T_{sp}$ and $T_5$, the controller moves to operate the compressors of first and second refrigeration circuits at low speed and operate the fan to direct load space air across first and second evaporator coils to cool load space air;

if the temperature T is less than the sum of the set point temperature $T_{sp}$ and the temperature constant $T_5$, and if the temperature T is greater than or equal to the sum of the set point temperature $T_{sp}$ and the temperature constant $T_6$ the controller moves to operate the compressor of the first refrigeration circuit at low speed and operate the fan to direct load space air across the first evaporator coil to cool load space air;

if the temperature T is less than the sum of the set point temperature $T_{sp}$ and a temperature constant $T_6$ but greater than $T_{sp}$, the controller is programmed to deactivate the compressors of all refrigeration circuits and operate the temperature control system in a null mode;

if the temperature T is less than $T_{sp}$ minus a temperature constant $T_1$, the controller is programmed to activate first and second heaters and the fan to heat load space air;

if the temperature T is greater than a total of $T_{sp}$ minus $T_1$ but less than $T_{sp}$ minus a temperature constant $T_2$, the controller is programmed to activate the first heater and fan to heat load space air; and if the temperature T is less than $T_{sp}$ but is greater than $T_{sp}$ minus $T_2$, the controller is programmed to deactivate the heaters and the compressors and operate the temperature control system in a null mode.

* * * * *